US011433269B1

(12) United States Patent
LoDuca

(10) Patent No.: US 11,433,269 B1
(45) Date of Patent: Sep. 6, 2022

(54) EXERCISE APPARATUS

(71) Applicant: Offset Ventures LLC, Whitestone, NY (US)

(72) Inventor: Salvatore LoDuca, Whitestone, NY (US)

(73) Assignee: Offset Ventures LLC, Whitestone, NY (US)

( * ) Notice: Subject to any disclaimer, the term of this patent is extended or adjusted under 35 U.S.C. 154(b) by 0 days.

(21) Appl. No.: 17/573,086

(22) Filed: Jan. 11, 2022

(51) Int. Cl.
*A63B 21/055* (2006.01)
*A63B 21/00* (2006.01)

(52) U.S. Cl.
CPC ..... *A63B 21/0552* (2013.01); *A63B 21/4035* (2015.10)

(58) Field of Classification Search
CPC ..... A63B 21/0004; A63B 21/00043; A63B 21/00178; A63B 21/00181; A63B 21/00185; A63B 21/002; A63B 21/0023; A63B 21/02; A63B 21/04; A63B 21/0407; A63B 21/0414; A63B 71/0054; A63B 2071/0063; A63B 2071/0072; A63B 2209/00; A63B 2209/02; A63B 2209/023; A63B 2209/026; A63B 2209/14; A63B 2225/09; A63B 21/0428; A63B 21/0435; A63B 21/0442; A63B 21/055; A63B 21/0552; A63B 21/0555; A63B 21/0557; A63B 21/4023; A63B 21/4027; A63B 21/4033; A63B 21/4035
See application file for complete search history.

(56) References Cited

U.S. PATENT DOCUMENTS

| | | | | |
|---|---|---|---|---|
| 4,059,265 | A | 11/1977 | Wieder et al. | |
| 11,229,814 | B1 * | 1/2022 | Week | A63B 21/0555 |
| 2010/0227744 | A1 | 9/2010 | Dang | |
| 2014/0274613 | A1 * | 9/2014 | DeMarco | A63B 21/4035 29/428 |
| 2015/0238799 | A1 * | 8/2015 | Arline | A63B 21/4035 482/129 |
| 2017/0182348 | A1 * | 6/2017 | Bertolutti | A63B 21/4043 |
| 2018/0236308 | A1 * | 8/2018 | Hyde | G09B 19/0038 |
| 2019/0046830 | A1 * | 2/2019 | Chiavegato | A63B 24/0062 |
| 2021/0370127 | A1 * | 12/2021 | Konopacz | A63B 21/4034 |

FOREIGN PATENT DOCUMENTS

| | | | | |
|---|---|---|---|---|
| KR | 20210112636 A * | 9/2021 | | A63B 21/055 |
| WO | 2018147889 A1 | 8/2018 | | |

* cited by examiner

*Primary Examiner* — Gary D Urbiel Goldner
(74) *Attorney, Agent, or Firm* — Carter, DeLuca & Farrell LLP; George Likourezos; Bradley J. Shelowitz

(57) ABSTRACT

An exercise apparatus includes an elongate cable being elastic and having opposing first and second ends configured to be grasped by a user. The elongate cable is configured to provide resistance to being stretched along its length in response to an application of a tension force to the first and second ends of the cable and return to its unstretched length upon the user releasing the tension force. The elongate cable includes a first portion having a first elasticity, and a second portion having a second elasticity that is different than the first elasticity of the first portion.

20 Claims, 3 Drawing Sheets

EXERCISE APPARATUS

FIELD

The present disclosure relates to an exercise apparatus and, more particularly, to an offset-loaded resistance band.

BACKGROUND

A common form of strength training is the use of elastic resistance bands where a user grasps opposing ends of the elastic band, cable, or cord and performs a pulling or pushing motion in a direction that stretches the band. Resistance bands are particularly useful because resistance increase as a user stretches the band. The increasing resistance counters momentum and lever arm advantages that reduce the effectiveness of conventional weight lifting in the course of an exercise movement such as a curl. However, conventional resistance bands are fabricated from a single band having the same degree of elasticity throughout.

SUMMARY

In recent years, sports physiologists have discovered that there are a number of benefits to offset loading, or asymmetric loading, in strength training. Offset loading is the use of different weights on either side of the body. This is typically achieved by using small hand-held dumbbells of different weights. For example, the lifter can do dumbbell curls with 10 pounds on one side and 15 pounds on the other side, or can do a dumbbell bench press with dumbbells of different weights, for example 25 pounds on the right side and 45 pounds on the left side.

There are a number of benefits to weight training with an offset load. The first is that it strengthens the muscles of the stomach and lower back. Since there are different weights on each side of the body, the core muscles are automatically engaged to keep the person stable. The second benefit is that it decreases the left to right muscular imbalance. Most people have stronger muscles on one side of the body simply because they have a dominant hand, which means that the arm of the dominant hand does far more work than the other arm. The body automatically compensates for the weaker side, and this creates an imbalance in the muscles of the body. The use of an offset load forces the weaker side to fully engage during the full motion of the exercise.

Accordingly, provided in accordance with aspects of the present disclosure is an exercise apparatus that allows a user to strength train using offset loading. The exercise apparatus includes an elastic, elongate cable having opposing first and second ends configured to be grasped by a user. The elongate cable is resiliently biased toward an unstretched length such that the elongate cable resists being stretched along its length in response to an application of a tension force to the first and second ends thereof and returns to the unstretched length upon a user releasing the tension force. The elongate cable includes a first portion having a first elastic modulus, and a second portion having a second elastic modulus that is different than the first elastic modulus of the first portion.

In aspects, the first portion of the elongate cable may be positioned between a central region of the elongate cable and the first end of the elongate cable, and the second portion of the elongate cable may be positioned between the central region of the elongate cable and the second end of the elongate cable.

In aspects, the first portion of the elongate cable may be positioned adjacent the first end of the elongate cable, and the second portion of the elongate cable may be positioned adjacent the second end of the elongate cable.

In aspects, the first portion of the elongate cable may have an end, and the second portion of the elongate cable may have an end that merges with the end of the first portion at a central region of the elongate cable.

In aspects, the first portion of the elongate cable may have a first end that forms the first end of the elongate cable and a second end. The second portion of the elongate cable may have a first end that forms the second end of the elongate cable and a second end. The second ends of the first and second portions may be adjacent one another at a central region of the elongate cable.

In aspects, the first portion of the elongate cable may have a length approximating a first half of the length of the elongate cable, and the second portion of the elongate cable may have a length approximating a second half of the length of the elongate cable.

In aspects, the first and second portions of the elongate cable may be fabricated from the same material, and the first portion of the elongate cable may be thicker than the second portion of the elongate cable.

In aspects, the first portion of the elongate cable may be fabricated from a different material than the second portion of the elongate cable.

In aspects, the first and second portions of the elongate cable may be monolithically formed with one another.

In aspects, the elongate cable may be fabricated from at least one of rubber or elastic fabric.

In aspects, the exercise apparatus may further include a first handle coupled to the first end of the elongate cable, and a second handle coupled to the second end of the elongate cable.

In accordance with another aspect of the present disclosure, a resistance band for strength training is provided that includes a first end having a first handle, a second end having a second handle, a central region between the first and second ends, a first portion having a first elastic modulus and positioned only between the first end and the central region, a second portion having a second elastic modulus that is different from the first elastic modulus. The second portion is positioned between the second end and the central region.

In aspects, the first portion may have an end, and the second portion may have an end that merges with the end of the first portion at the central region.

In aspects, the first portion may have a first end that forms the first end of the resistance band and a second end. The second portion may have a first end that forms the second end of the resistance band and a second end. The second ends of the first and second portions may be adjacent one another at the central region.

In aspects, the first and second portions may be fabricated from the same material, and the first portion may be thicker than the second portion.

In aspects, the first portion may be fabricated from a different material than the second portion.

As used herein, the term "distal" refers to the portion that is described which is further from a user, while the term "proximal" refers to the portion that is being described which is closer to the user. Terms including "generally," "about," "substantially," and the like, as utilized herein, are meant to encompass variations, e.g., manufacturing tolerances, material tolerances, use and environmental tolerances, measurement variations, and/or other variations, up to and including plus or minus 10 percent. Further, any or all of the aspects described herein, to the extent consistent, may be used in conjunction with any or all of the other aspects described.

BRIEF DESCRIPTION OF THE DRAWINGS

The above and other aspects and features of the present disclosure will become more apparent in light of the following detailed description when taken in conjunction with the accompanying drawings wherein like reference numerals identify similar or identical elements.

DETAILED DESCRIPTION

Figure 1:
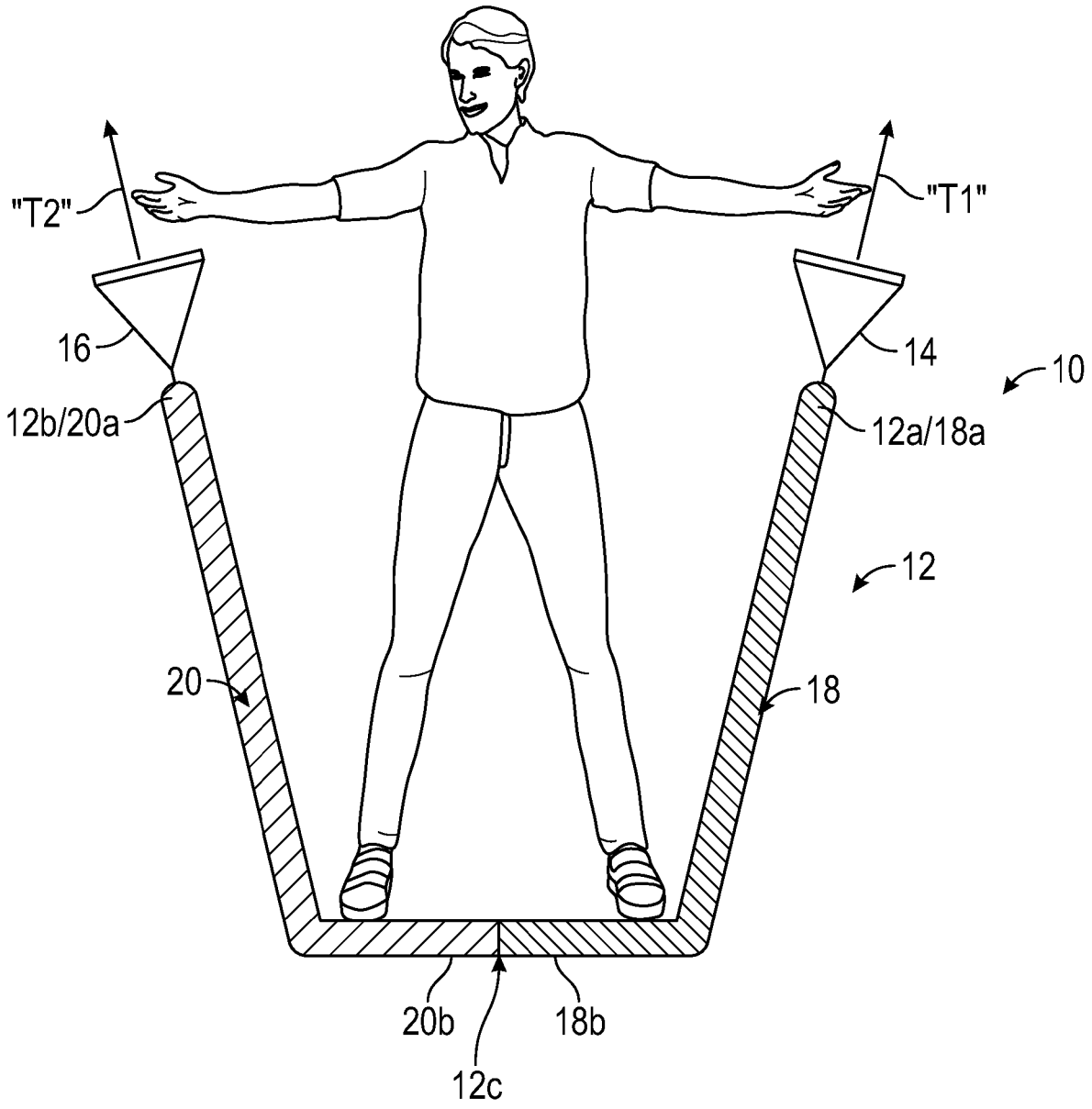
FIG. 1 is a front view of a user performing a strength training exercise with an exercise apparatus provided in accordance with the present disclosure.
Figure 2:
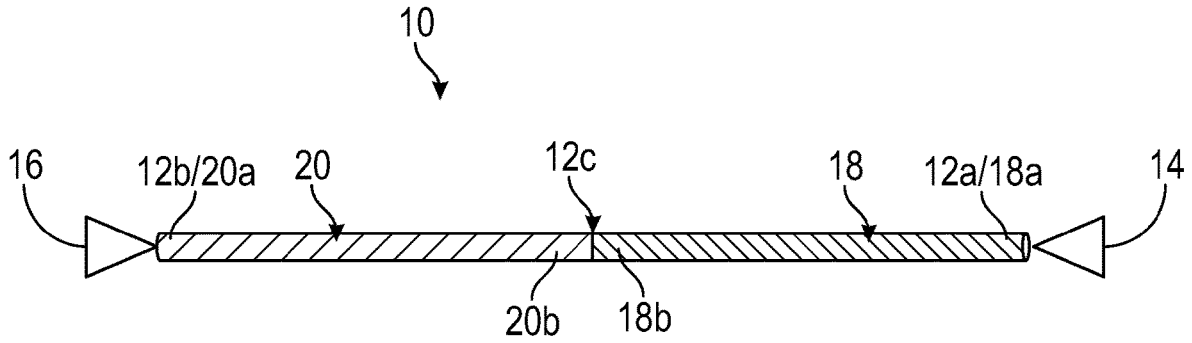
FIG. 2 is a front, perspective view illustrating the exercise apparatus of FIG. 1.

Turning to FIGS. 1 and 2, an exercise apparatus in accordance with aspects of the present disclosure is generally identified by reference numeral 10. The exercise apparatus 10 may be a resistance band including an elastic, elongate cable 12 and a pair of handle 14, 16 coupled to opposing first and second ends 12*a*, 12*b* of the elongate cable 12. In aspects, elongate the cable 12 may be a hollow cord, a solid cylindrical cable, a flattened band, or the like. The elongate cable 12 has a length from about 3 feet to about 5 feet. Other suitable sizes for the elongate cable 12 are also contemplated. The elongate cable 12 may be fabricated from an elastomeric material, such as, for example, rubber, or an elastic fabric. It is contemplated that the elongate cable 12 may be fabricated from any other suitable material configured to stretch under a tensile load and return to its original length when the tensile load is released.

The elongate cable 12 has the opposing first and second ends 12*a*, 12*b* supporting the first and second handles 14, 16, which are configured to be grasped by a user, and a central region 12*c* positioned between the first and second ends 12*a*, 12*b*. The handles 14, 16 may be permanently affixed to the first and second ends 12*a*, 12*b* of the elongate cable 12 or detachably secured to the first and second ends 12*a*, 12*b* of the elongate cable 12 via a hook and loop strap, shackle, knot, or the like. In other aspects, the first and second ends 12*a*, 12*b* of the elongate cable 12 may be devoid of handles.

The elongate cable 12 includes a first portion or segment 18 having a first elastic modulus, and a second portion or segment 20 having a second elastic modulus that is different than the first elastic modulus of the first portion 18. For example, the first portion 18 may be more elastic than the second portion 20 such that a greater tensile force is required to stretch the second portion 20 of the elongate cable 12 the same amount as the first portion 18. The first and second portions 18, 20 may be fabricated from the same material having different diameters or wall thicknesses from one another thereby giving each a different elastic modulus.

In other aspects, the first and second portions 18, 20 may have different elastic moduli from one another due to the first and second portions 18, 20 being fabricated from different materials. For example, the first portion 18 may be fabricated from a first type of rubber or elastic fabric having a predetermined elastic modulus whereas the second portion 20 may be fabricated from a second type of rubber or elastic fabric having a predetermined elastic modulus that is greater than the elastic modulus of the first portion 18.

The first portion 18 of the elongate cable 12 is positioned between the central region 12*c* of the elongate cable 12 and the first end 12*a* of the elongate cable 12, and the second portion 20 of the elongate cable 12 is positioned between the central region 12*c* of the elongate cable 12 and the second end 12*b* of the elongate cable 12. The first portion 18 of the elongate cable 12 may have a first end 18*a* positioned adjacent to or forming the first end 12*a* of the elongate cable 12, and a second end 18*b* positioned at and forming part of the central region 12*c* of the elongate cable 12. Similarly, the second portion 20 of the elongate cable 12 may have a first end 20*a* positioned adjacent to or forming the second end 12*b* of the elongate cable 12, and a second end 20*b* positioned at and forming part of the central region 12*c* of the elongate cable 12. The second ends 18*b*, 20*b* of the first and second portions 18, 20 may merge with one another, thereby together forming the central region 12*c* of the elongate cable 12. In aspects, the second ends 18*b*, 20*b* of the first and second portions 18, 20 may be monolithically formed with one another or integrally connected to one another.

The first portion 18 of the elongate cable 12 may have a length equal to a first half of the length of the elongate cable 12, and the second portion 20 of the elongate cable 12 may have a length equal to a second half of the length of the elongate cable 12 such that the first and second portions 18, 20 together make up the entire length of the elongate cable 12.

As shown in FIG. 1, to perform a particular exercise using the exercise apparatus 10, for example, bicep curls, a user may position their feet shoulders-width apart and on the elongate cable 12 with the central region 12*c* of the elongate cable 12 positioned between their feet. The user may grasp the handles 14, 16 of the exercise apparatus 10 with their respective left and right hands and apply a tensile force on the first and second ends 12*a*, 12*b* of the elongate cable 12 by bending their forearms upwardly about their elbows.

Since the second portion 20 of the elongate cable 12 has a different elastic modulus than the first portion 18 (e.g., a greater elastic modulus), for the user to lift or pull the handles 14, 16 upwardly at the same rate, the left arm of the user must apply a first tensile load "T1" and the right arm of the user must apply a second tensile load "T2" that is greater than the first tensile load "T1." In this way, the user is performing an offset loaded bicep curl. It is contemplated that other types of offset loaded exercises may be performed using the exercise apparatus 10, such as, for example, squats, lateral raises, leg press, tricep press, etc.

Figure 3:
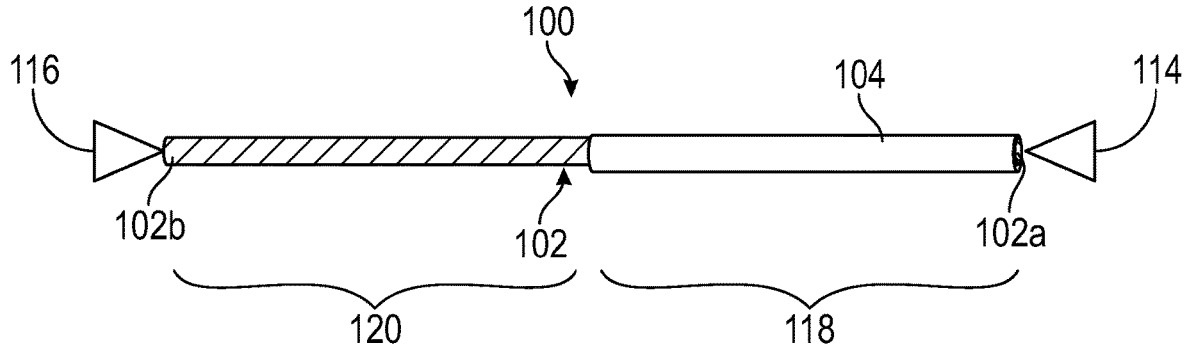
FIG. 3 is a front, perspective view illustrating another aspect of an exercise apparatus.

With reference to FIG. 3, another type of exercise apparatus 100 for offset loaded strength training or rehabilitation is shown. Exercise apparatus 100 is similar to and may include any of the features of exercise apparatus 10 (FIGS. 1 and 2) except as explicitly contradicted below.

Exercise apparatus 100 includes an elongate cable 102 having first and second ends 102*a*, 102*b*, and handles 114, 116 coupled to the respective first and second ends 102*a*, 102*b*. Instead of the elongate cable 102 having a different elasticity in different portions thereof as is the case in the exercise apparatus 10 of FIGS. 1 and 2, the entire length of the elongate cable 102 may be fabricated from a single elastic material with the same modulus of elasticity throughout. However, the exercise apparatus 100 further includes a sheath 104 that enshrouds only approximately a first half 118 of the elongate cable 102. As such, the sheath 104 gives the first half 118 of the exercise apparatus 100 a different elastic modulus than the second half 120, which is not covered by the sheath 104.

Figure 4:
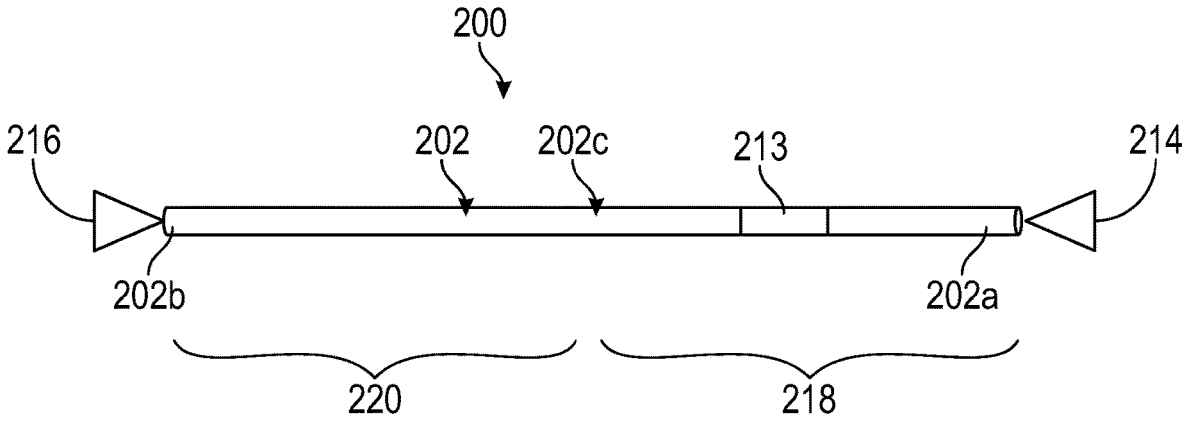
FIG. 4 is a front, perspective view illustrating yet another aspect of an exercise apparatus.

With reference to FIG. 4, another type of exercise apparatus 200 for offset loaded strength training or rehabilitation is shown. Exercise apparatus 200 is similar to and may include any of the features of exercise apparatus 10 (FIGS. 1 and 2) except as explicitly contradicted below.

Exercise apparatus 200 includes an elongate cable 202 having first and second ends 202*a*, 202*b*, a central region 202*c* between the first and second ends 202*a*, 202*b*, and handles 214, 216 coupled to the respective first and second ends 202*a*, 202*b*. The entire elongate cable 202 may be fabricated from a single material (e.g., rubber with a preset elastic modulus) but for a single segment 213 formed with the elongate cable 202 at a position between the central region 202*c* of the elongate cable 202 and the first end 202*a* of the elongate cable 202. The single segment 213 has a different modulus of elasticity than the remainder of the elongate cable 202 (e.g., a greater modulus of elasticity). As such, the half 218 of the elongate cable 202 with the segment 213 has a different overall modulus of elasticity than the half 220 of the cable 202 without the segment 213.

While several aspects and features of the disclosure are detailed above and shown in the drawings, it is not intended that the disclosure be limited thereto, as it is intended that the disclosure be as broad in scope as the art will allow and that the specification be read likewise. Therefore, the above description and accompanying drawings should not be construed as limiting, but merely as exemplifications of particular configurations. Those skilled in the art will envision other modifications within the scope and spirit of the claims appended hereto.

What is claimed is:

1. An exercise apparatus, comprising:

an elongate cable being elastic and having opposing first and second ends configured to be grasped by a user, the elongate cable being resiliently biased toward an unstretched length such that the elongate cable resists being stretched along a length thereof in response to an application of a tension force to the first and second ends thereof and the elongate cable is configured to return to the unstretched length upon the user releasing the tension force, wherein the elongate cable includes a first portion having a first elastic modulus, and a second portion having a second elastic modulus that is different than the first elastic modulus of the first portion, wherein the first and second portions of the elongate cable are monolithically formed with one another.

2. The exercise apparatus according to claim 1, wherein the first portion of the elongate cable is positioned between a central region of the elongate cable and the first end of the elongate cable, and the second portion of the elongate cable is positioned between the central region of the elongate cable and the second end of the elongate cable.

3. The exercise apparatus according to claim 1, wherein the first portion of the elongate cable is positioned adjacent to the first end of the elongate cable, and the second portion of the elongate cable is positioned adjacent to the second end of the elongate cable.

4. The exercise apparatus according to claim 1, wherein the first portion of the elongate cable has an end, and the second portion of the elongate cable has an end that is monolithically formed with the end of the first portion at a central region of the elongate cable.

5. The exercise apparatus according to claim 1, wherein the first portion of the elongate cable has a first end that forms the first end of the elongate cable and a second end, and the second portion of the elongate cable has a first end that forms the second end of the elongate cable and a second end, the second ends of the first and second portions being adjacent to one another at a central region of the elongate cable.

6. The exercise apparatus according to claim 5, wherein the first portion of the elongate cable has a length approximating a first half of the length of the elongate cable, and the second portion of the elongate cable has a length approximating a second half of the length of the elongate cable.

7. The exercise apparatus according to claim 1, wherein the first and second portions of the elongate cable are fabricated from a same material, and the first portion of the elongate cable is thicker than the second portion of the elongate cable.

8. The exercise apparatus according to claim 1, wherein the first portion of the elongate cable is fabricated from a different material than the second portion of the elongate cable.

9. The exercise apparatus according to claim 1, wherein the elongate cable is fabricated from at least one of rubber or elastic fabric.

10. The exercise apparatus according to claim 1, further comprising:

a first handle coupled to the first end of the elongate cable; and a second handle coupled to the second end of the elongate cable.

11. A resistance band for strength training, the resistance band comprising:

a first end having a first handle;

a second end having a second handle;

a central region between the first and second ends;

a first portion having a first elastic modulus and positioned only between the first end and the central region; and a second portion having a second elastic modulus that is different from the first elastic modulus, the second portion being positioned between the second end and the central region, wherein the first and second portions are monolithically formed with one another.

12. The resistance band according to claim 11, wherein the first portion has an end, and the second portion has an end that is monolithically formed with the end of the first portion at the central region.

13. The resistance band according to claim 11, wherein the first portion has a first end that forms the first end of the resistance band and a second end, and the second portion has a first end that forms the second end of the resistance band and a second end, the second ends of the first and second portions being adjacent to one another at the central region.

14. The resistance band according to claim 11, wherein the first and second portions are fabricated from a same material, and the first portion is thicker than the second portion.

15. The resistance band according to claim 11, wherein the first portion is fabricated from a different material than the second portion.

16. The resistance band according to claim 11, wherein the first and second portions are fabricated from at least one of rubber or elastic fabric.

17. An exercise apparatus, comprising:

an elongate cable being elastic and having opposing first and second ends configured to be grasped by a user, the elongate cable being resiliently biased toward an unstretched length such that the elongate cable resists being stretched along a length thereof in response to an application of a tension force to the first and second ends thereof and the elongate cable is configured to return to the unstretched length upon the user releasing the tension force, wherein the elongate cable includes a first portion having a first elastic modulus, and a second portion having a second elastic modulus that is different than the first elastic modulus of the first portion, wherein the first and second portions of the elongate cable are directly coupled to one another.

18. The exercise apparatus according to claim 17, wherein the first portion of the elongate cable is positioned between a central region of the elongate cable and the first end of the elongate cable, and the second portion of the elongate cable is positioned between the central region of the elongate cable and the second end of the elongate cable.

19. The exercise apparatus according to claim 17, wherein the first portion of the elongate cable is positioned adjacent to the first end of the elongate cable, and the second portion of the elongate cable is positioned adjacent to the second end of the elongate cable.

20. The exercise apparatus according to claim 17, wherein the first portion of the elongate cable has an end, and the second portion of the elongate cable has an end that merges with the end of the first portion at a central region of the elongate cable.

* * * * *